US007383829B2

(12) United States Patent
Shieh

(10) Patent No.: US 7,383,829 B2
(45) Date of Patent: Jun. 10, 2008

(54) OIL DRAIN DEVICE FOR AN ENGINE OIL SEPARATOR

(75) Inventor: Teng-Hua Shieh, Ann Arbor, MI (US)

(73) Assignee: Toyota Motor Engineering & Manufacturing North America, Inc., Ann Arbor, MI (US)

( * ) Notice: Subject to any disclaimer, the term of this patent is extended or adjusted under 35 U.S.C. 154(b) by 130 days.

(21) Appl. No.: 11/350,422

(22) Filed: Feb. 9, 2006

(65) Prior Publication Data

US 2007/0181107 A1 Aug. 9, 2007

(51) Int. Cl.
*F01M 13/02* (2006.01)

(52) U.S. Cl. ..... 123/572

(58) Field of Classification Search ..... 123/572–574, 123/41.86, 198 DA
See application file for complete search history.

(56) References Cited

U.S. PATENT DOCUMENTS 5,022,376 A * 6/1991 Hudson et al. ..... 123/572
5,617,834 A * 4/1997 Lohr ..... 123/572
5,860,396 A * 1/1999 Muth ..... 123/41.86
6,802,303 B2 * 10/2004 Håkansson ..... 123/574
7,246,612 B2 * 7/2007 Shieh et al. ..... 123/572

FOREIGN PATENT DOCUMENTS

JP 07-066876 2/1995

* cited by examiner

*Primary Examiner*—Marguerite McMahon
(74) *Attorney, Agent, or Firm*—Gifford, Krass, Sprinkle, Anderson & Citkowski, P.C.

(57) ABSTRACT

An oil drainage device for an oil separator of an internal combustion engine includes a first chamber, a second chamber, a connector and a conduit. The first chamber receives oil from the oil separator. The second chamber is coupled to a sump. The connector extends between the first and second chambers. The connector defines a fluid path along which oil can flow between the first and second chambers. The conduit is disposed within the connector and provides a path for crankcase blow-by gases that is separate from the fluid path.

9 Claims, 6 Drawing Sheets

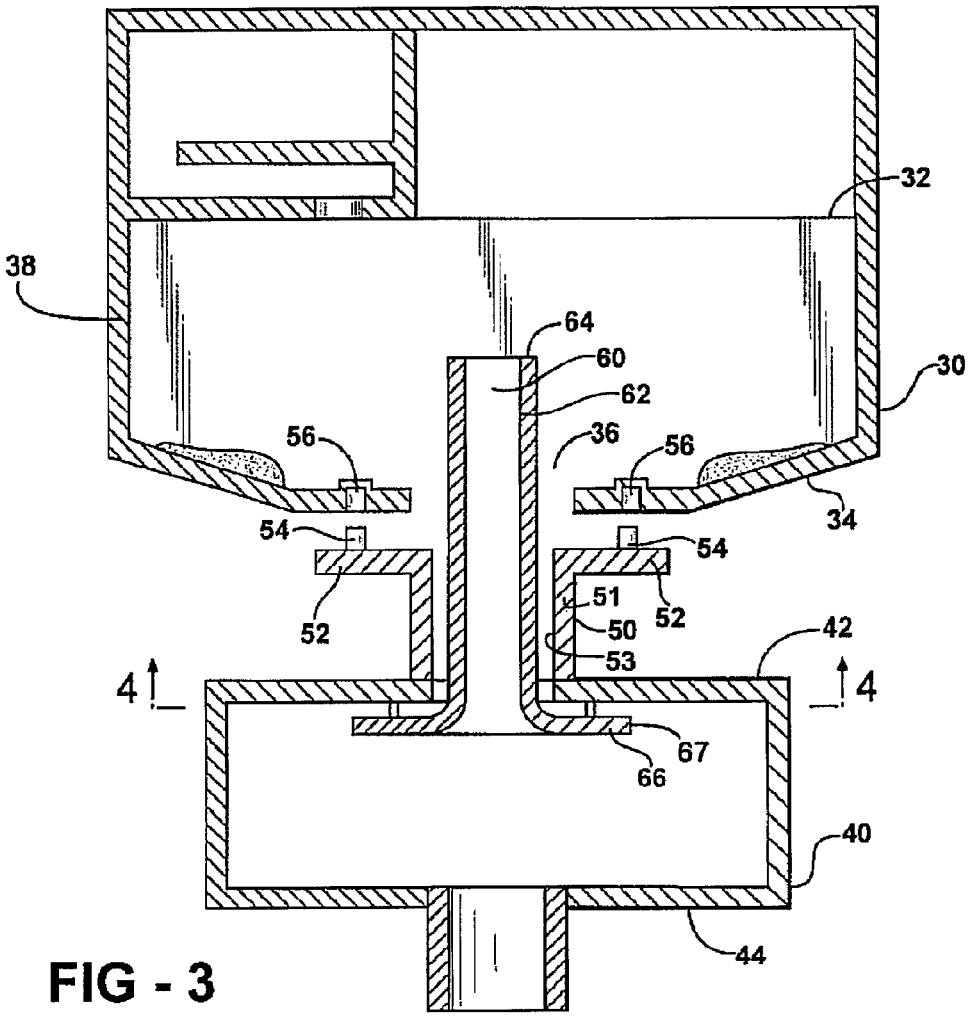
FIG - 3
FIG - 4
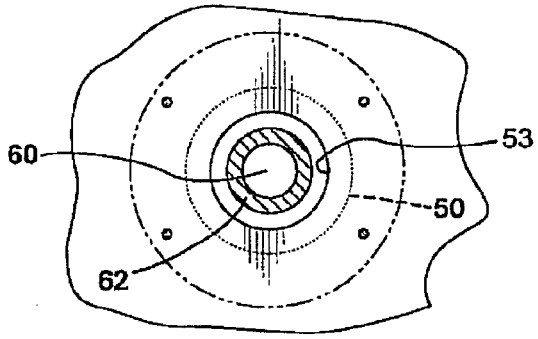

OIL DRAIN DEVICE FOR AN ENGINE OIL SEPARATOR

BACKGROUND OF THE INVENTION

1. Field of the Invention

The invention relates to a positive crankcase ventilation (PCV) device for internal combustion engines. More specifically, the invention relates to an improved oil drain device having a dedicated path for blow-by gases that is separate from a fluid path for oil removed from crankcase gases.

2. Description of the Related Art

An internal combustion engine typically includes a combustion chamber, where a fuel air mixture is burned to cause movement of a set of reciprocating pistons, and a crankcase, which contains the crankshaft driven by the pistons. During operation, it is normal for the engine to experience "blow-by," wherein combustion gases leak past the pistons from the combustion chamber and into the crankshaft. These combustion or blow-by gases contain moisture, acids and other undesired by-products of the combustion process.

An engine typically includes a Positive Crankcase Ventilation (PCV) system for removing harmful gases from the engine and prevents those gases from being expelled into the atmosphere. The PCV system does this by using manifold vacuum to draw vapors from the crankcase into the intake manifold. Vapor is then carried with the fuel/air mixture into an intake manifold of the combustion chambers where it is burned. Generally, the flow or circulation within the system is controlled by the PCV valve, which acts as both a crankcase ventilation system and as a pollution control device.

It is normal for blow-by gases to also include a very fine oil mist. The oil mist is carried by the PCV system to the manifold. The oil mist is then burned in the combustion chamber along with the fuel/air mixture. This results in an increase in oil consumption. A known method of removing oil from the blow-by gases is to use a labyrinth, punched-hole impact plate (PIP) or cyclone-type separator design. A path is provided through which small oil droplets pass and collects into larger droplets. The droplets are then re-introduced back to a sump via a drain device. The sump generally holds excess oil in the system. Examples of oil separators are disclosed in U.S. Pat. Nos. 6,279,556 B1 and 6,626,163 B1 to Busen et al., both of which are assigned to Walter Hengst GmbH & Co. KG.

Conventional oil drain devices have a single passage for both blowby gases and oil. The blowby gas is driven to the manifold by a pressure difference between the manifold and sump, while the oil is driven by gravity to the sump. The flow of blow-by gas hinders or prevents this flow of oil to the sump.

Thus, it remains desirable to provide an improved oil drain device that minimizes disturbance of the oil moving between the oil separator and the sump by the blow-by gases.

SUMMARY OF THE INVENTION

According to one aspect of the invention, an oil drainage device is provided for an oil separator of an internal combustion engine. The invention improves over conventional designs by providing a dedicated path for the blow-by gases that is separate from the fluid path for the oil. The flow of the blow-by gases does not interfere with the flow of oil, thus resulting in increased drainage efficiency of the oil drain device over conventional designs. The oil drainage device includes a first chamber, a second chamber, a connector and a conduit. The first chamber receives oil from the oil separator. The second chamber is coupled to a sump. The connector extends between the first and second chambers. The connector defines a fluid path along which oil can flow between the first and second chambers. The conduit is disposed within the connector and provides a path for crankcase blow-by gases that is separate from the fluid path.

According to another aspect of the invention, an oil drainage device is provided for an oil separator of an internal combustion engine. The oil drainage device includes a first chamber, a second chamber and a connector. The first chamber receives oil from the oil separator. The second chamber is coupled to a sump. The connector extends between the first and second chambers. A fluid path extends through the connector along which oil can flow between the first and second chambers. A path extends through the connector through which crankcase blow-by gases can flow and remain substantially separated from the oil flowing along the fluid path.

BRIEF DESCRIPTION OF THE DRAWINGS

Advantages of the present invention will be readily appreciated as the same becomes better understood by reference to the following detailed description when considered in connection with the accompanying drawings, wherein:

FIG. 3 is a partially exploded, cross sectional view of the oil drainage device of the first embodiment;

FIG. 4 is a cross sectional view of the oil drainage device of the first embodiment, wherein the cross section is taken as indicated in A-A in FIG. 3;

DETAILED DESCRIPTION OF THE INVENTION

The invention provides an oil drain device for use with an oil separator for removing oil from PCV gases of an internal combustion engine. The oil drain device enhances the collection and drainage of oil separated from PCV gases by the oil separator. The invention improves over conventional designs by providing a dedicated path for the blow-by gases that is separate from the fluid path for the oil. The flow of the blow-by gases does not interfere with the flow of oil, thus resulting in increased drainage efficiency of the oil drain device 10 over conventional designs.

Figure 1:
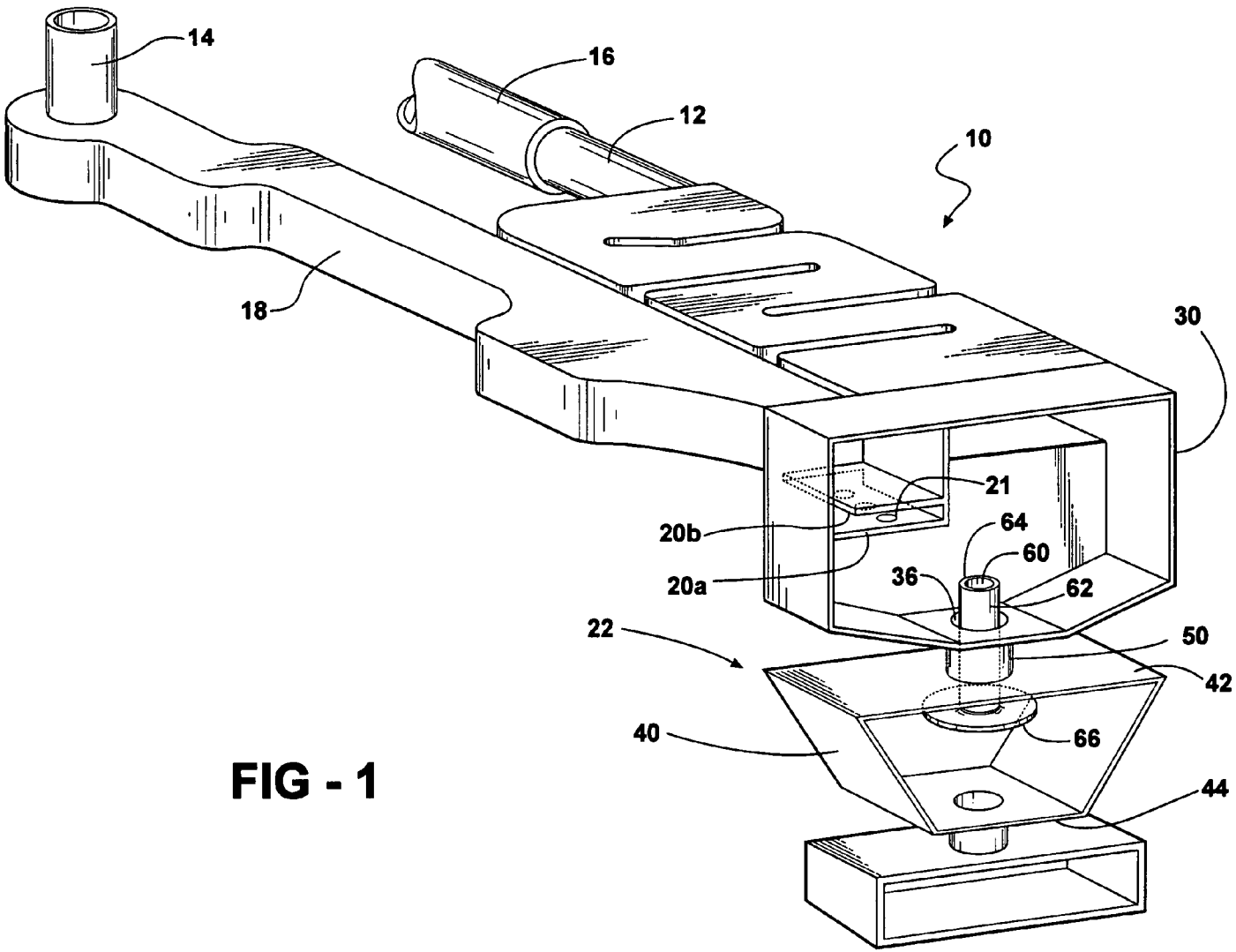
FIG. 1 is a perspective view of an oil separator and drainage device according to the invention.

Referring to the FIGS. 1, the oil separator is indicated at 10. The oil separator 10, as shown in the figures, is a labyrinth design with walls arranged in the form of a labyrinth. It should be readily appreciated by those having ordinary skill in the art that the oil separator 10 can be of any type, such as a spiral design having walls in the form of a spiral. An example of a spiral design is provided in copending U.S. patent application Ser. No. 10/961,557 filed on Oct. 8, 2004, which is incorporated herein by reference in its entirety.

The oil separator 10 includes an inlet 12 and an outlet 14. Crankcase gases are fed to the inlet 12 of the oil separator 10 via a tube 16. Substantially de-oiled gases and oil exiting the oil separator 10 pass into a collection or oil drainage device 22. The gases are directed through a horizontally oriented punched plate 20*a* and impactor plate 20*b* (PIP) arrangement, as shown in FIG. 1. The punched plate 20*a* includes a plurality of holes 21 through which the gases can pass. The impactor plate 20*b* is generally parallel to and closely spaced from the punched plate 20*a* to promote removal of small oil droplets remaining in the gases. The de-oiled gases move from the PIP arrangement 20 to a longitudinally extending tunnel 18. The de-oiled gases then exit the tunnel 18 via the outlet 14 and are introduced to the manifold. Oil separated from the exiting gases is directed into the oil drainage device. Several embodiments of the oil drainage device are now described in greater detail below.

Figure 2:
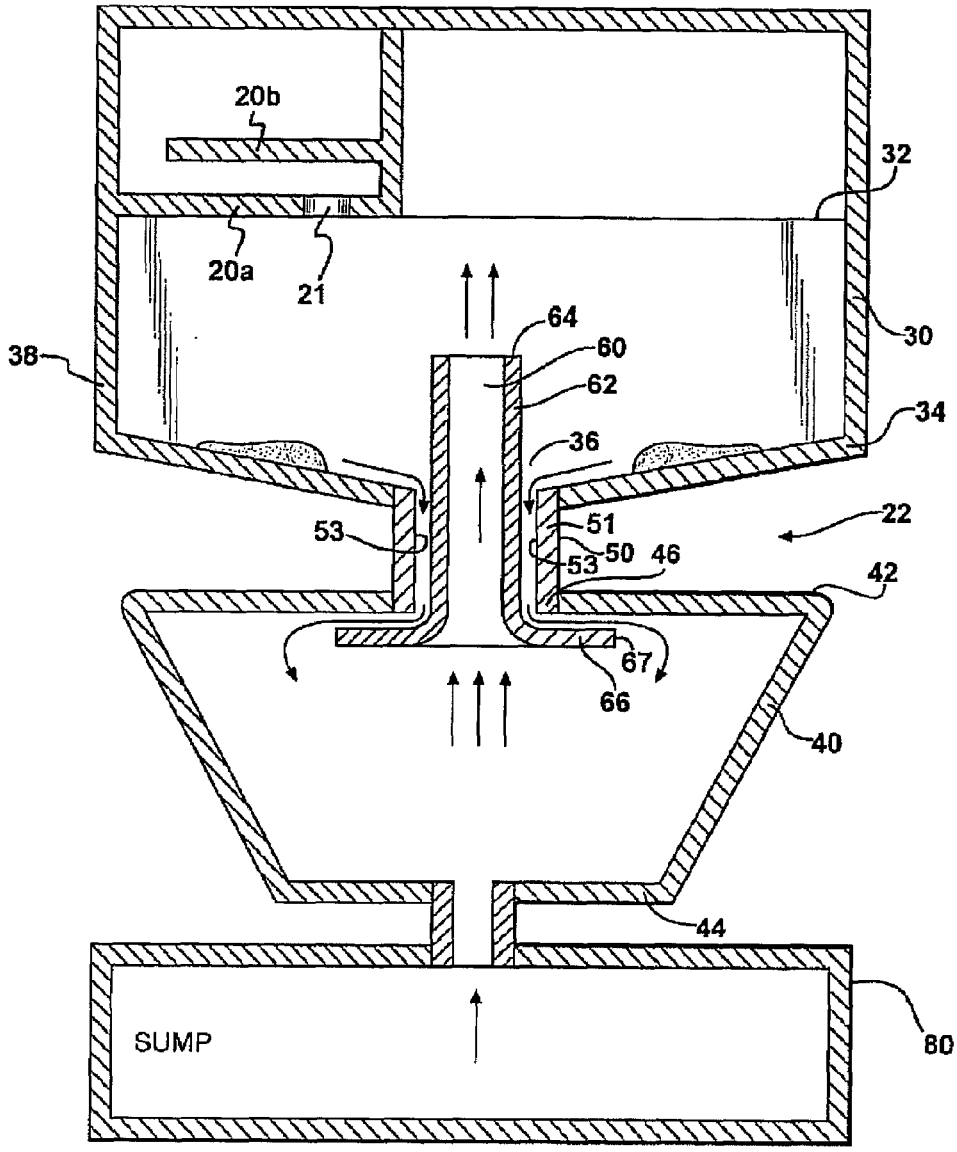
FIG. 2 is a cross sectional view of the oil drainage device according to a first embodiment of the invention.

In FIGS. 2-4, a first embodiment of the oil drain device is indicated at 22. The device 22 includes a first chamber 30. The first chamber 30 includes opposite and spaced apart top 32 and bottom 34 walls. The top 32 and bottom 34 walls extend between outer walls 38. A hole 36 is formed in the bottom wall 34. The bottom walls 34 of the second chamber 30 are angled downwardly relative to the outer walls 38 to promote funneling of the oil toward the hole 36. A second chamber 40 is disposed below the first chamber 30. The second chamber 40 has opposite and spaced apart upper 42 and lower 44 walls. An aperture or hole 46 is formed in the upper wall 42 of the second chamber 40.

The holes 36, 46 in the first 30 and second 40 chambers are generally axially aligned. A connector 50 includes a side wall 51 extending between bottom wall 34 of the first chamber 30 and the upper wall 42 of the second chamber 40. The side wall 51 of the connector 50 has an inner surface 53 defining a fluid path between the holes 36, 46 of the first 30 and second 40 chambers. The fluid path is illustrated by arrows pointing downwardly, as viewed in the figures.

A conduit 60 is disposed within the connector 50 that provides a path between the first 30 and second 40 chambers for blow-by gases. The path for the blow-by gases is illustrated by arrows pointed upwardly, as viewed in the figures. The conduit 60 has a generally cylindrical wall 62 that extends between a top end 64 and a bottom end 66. The wall 62 provides separation between the fluid path for the oil and the path for the blow-by gases. The top end 64 of the conduit 60 extends upwardly beyond the bottom wall 34 of the first chamber 30, so that the blow-by gases do not interfere with the flow of oil to the fluid path. The bottom end 66 of the conduit 60 includes a flange 67 that flares outwardly in the form of an inverted funnel. The bottom end 66 of the wall 62 provides an inlet for the blow-by gases passing.

In FIG. 3, the first 30 and second 40 chambers are shown in an exploded view just prior to being assembled to each other. The connector 50 is integrally formed with the second chamber 40. A flange 52 extends outwardly from a distal end of the connector 50. A boss 54 extends outwardly from the flange 52. The boss 54 extends into a corresponding recess 56 formed in the bottom wall 34 of the first chamber 30. The flange 52 is then fixedly secured to the bottom wall 34 by any suitable method known by those skilled in the art, such as by adhesives or sonic welding. As shown in FIG. 4, a plurality of bosses 54 and recesses 56 may be used to locate the connector 50 relative to the first chamber 30. The flared bottom end 66 of the conduit 60 is fixedly secured to the upper wall 42 of the second chamber 40. Thus, during assembly of the first 30 and second 40 chambers, the top end 64 of the conduit 60 is first inserted through the hole 36 in the bottom wall 34. It should be appreciated that the aforementioned boss 54 and recess 56 arrangement may also be used to fixedly secure the connector to the second chamber 40.

In use, crankcase gases enter the oil separator 10 through the inlet 12. Oil mist is separated from the gases in the oil separator 10. Oil collects along the bottom wall 34 of the first chamber 30. The oil is funneled toward the hole 36 due to the angle of the bottom wall 34. The oil passes from the first chamber 30 to the second chamber 40 via the fluid path defined between the conduit 60 and the side wall 51 of the connector 50. At the same time, blow-by gases may also pass through the connector 50 via the conduit 60. The invention improves over conventional designs by providing a dedicated path for the blow-by gases that is separate from the fluid path for the oil. The flow of the blow-by gases does not interfere with the flow of oil, thus resulting in increased drainage efficiency of the oil drain device 10 over conventional designs. Oil is then passed to the sump 80 for recirculation through the crankcase. De-oiled gases are directed through the PIP arrangement 20. High pressure between the punched plate 20*a* and the impactor plate 20*b* separates remaining fine oil mist from the gases. The oil moves to the drain device 22 due to gravity. The de-oiled gases continues to the tunnel and exits via the outlet 14 to the manifold.

Figure 5:
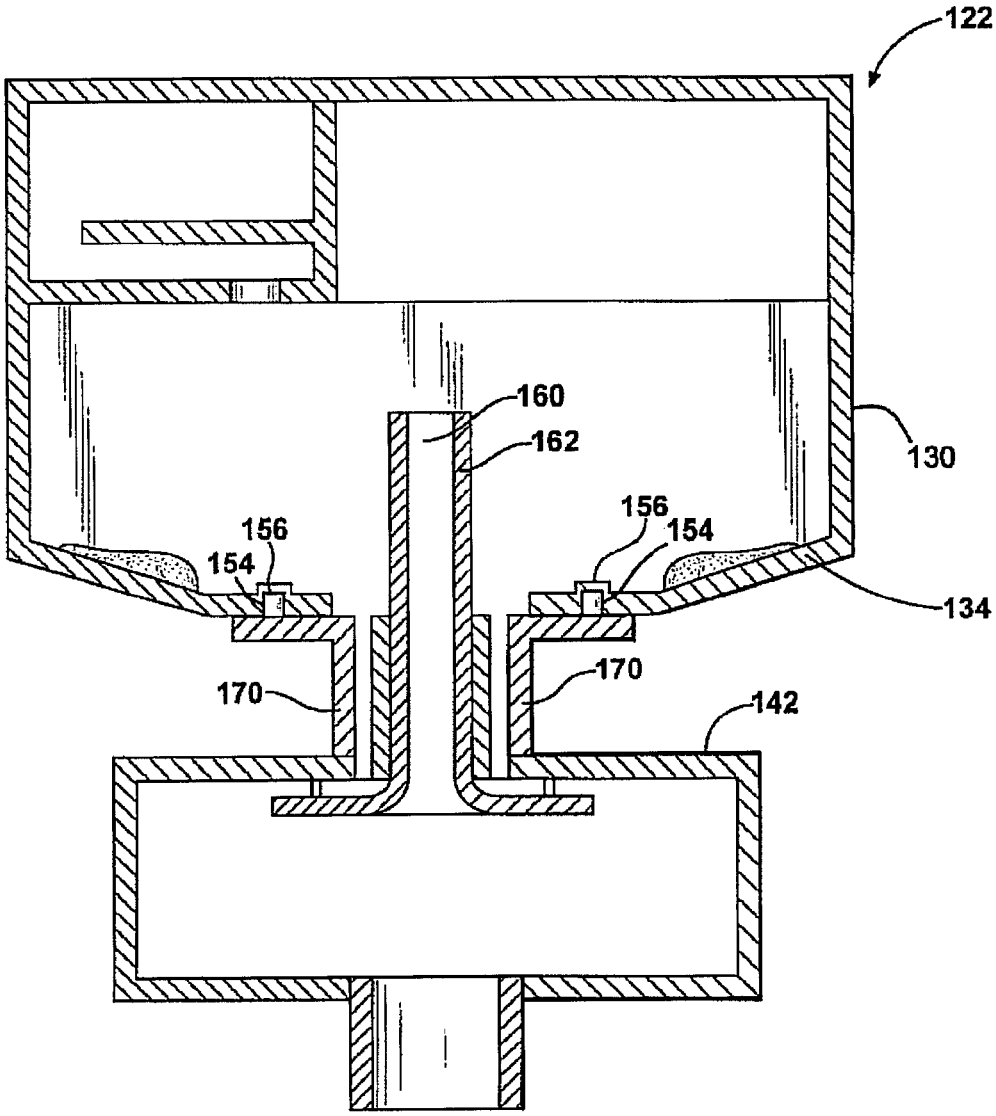
FIG. 5 is a cross sectional view of the oil drainage device according to a second embodiment of the invention.
Figure 6:
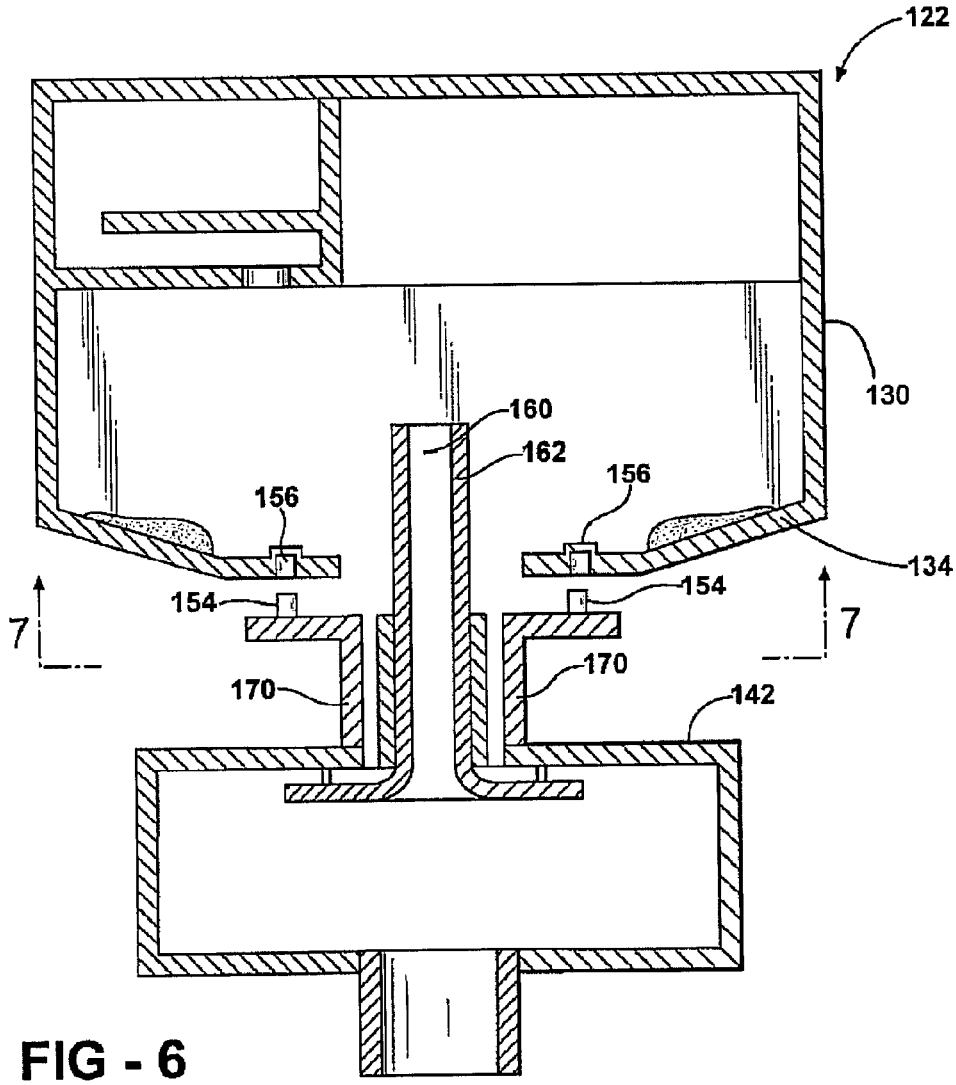
FIG. 6 is a partially exploded, cross sectional view of the oil drainage device of the second embodiment.
Figure 7:
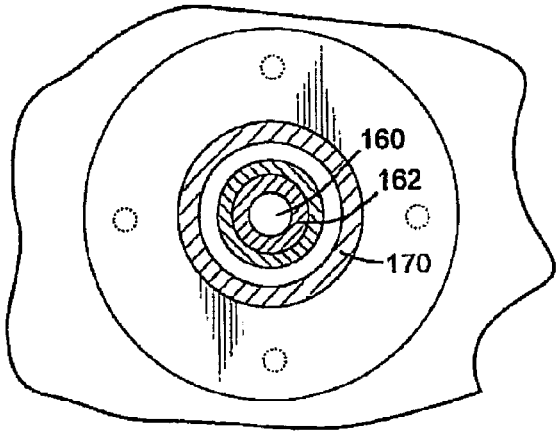
FIG. 7 is a cross sectional view of the oil drainage device of the second embodiment, wherein the cross section is taken as indicated in B-B in FIG. 6.

Referring to FIGS. 5-7, a second embodiment of the oil drainage device is indicated at 122. In this embodiment, the fluid path for the oil between the first 130 and second 140 chambers is defined by a plurality of tubes 170, which extend between the bottom wall 134 and the upper wall 42. The tubes 170 are generally parallel with the conduit 160. The tubes 170 are positioned adjacent the conduit wall 162. As best shown in FIG. 6, the tubes 170 are integrally formed with the upper wall 142 of the second chamber 140. The top ends of the tubes 170 are located and fixedly secured to the bottom wall 134 of the first chamber 130 by the boss 154 and recess 156 arrangement of the previous embodiment.

Figure 8:
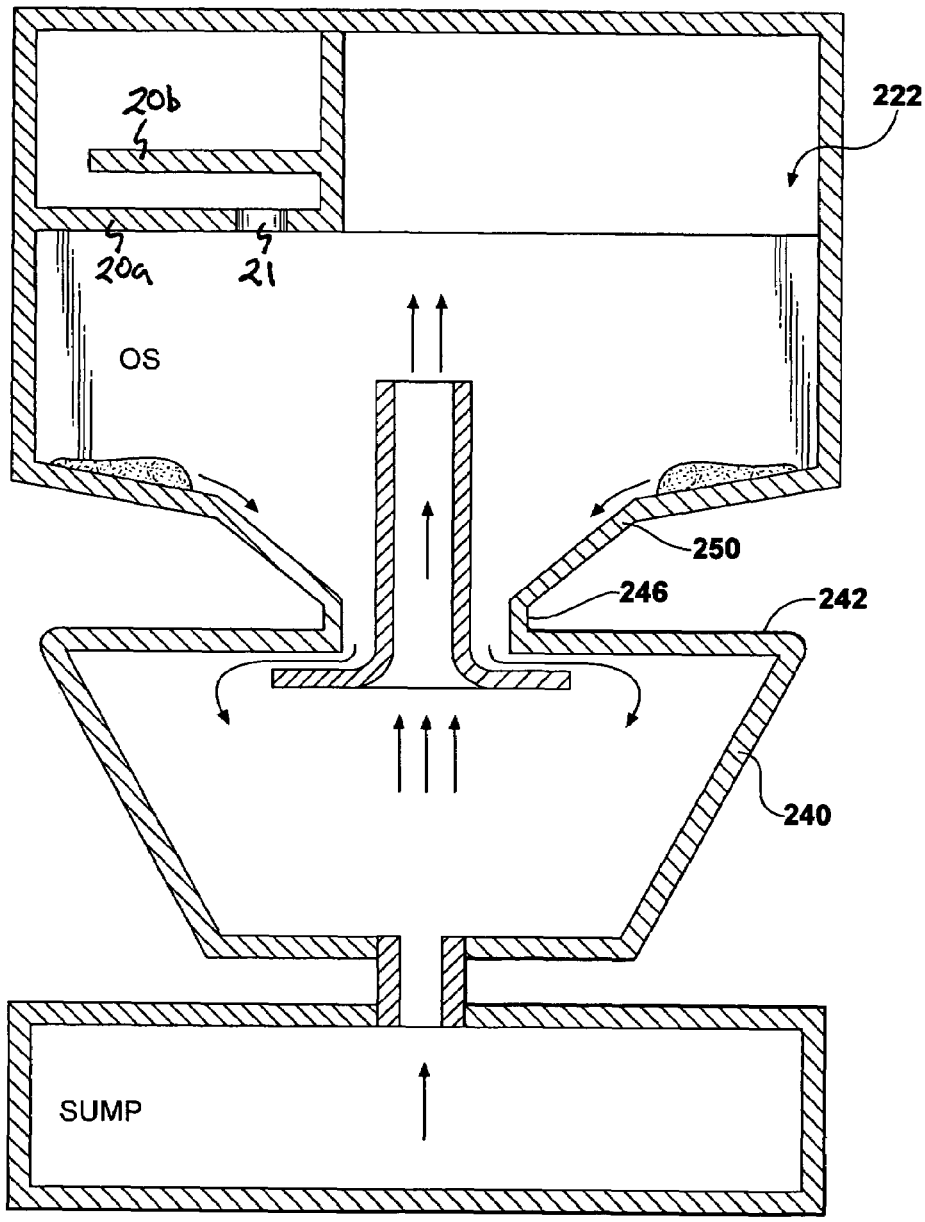
FIG. 8 is a cross sectional view of the oil drainage device according to a third embodiment of the invention.

Referring to FIG. 8, a third embodiment of the oil drainage device is indicated at 222. In this embodiment, the walls of the connector 250 are oriented at a generally 45 degree angle to provide enhanced funneling of the oil toward the hole 246 in the upper wall 242 of the second chamber 240.

The invention has been described in an illustrative manner. It is, therefore, to be understood that the terminology used is intended to be in the nature of words of description rather than of limitation. Many modifications and variations of the invention are possible in light of the above teachings. Thus, within the scope of the appended claims, the invention may be practiced other than as specifically described.

The invention claimed is:

1. An oil drainage device for an oil separator of an internal combustion engine, said oil drainage device comprising:

a first chamber that receives oil from the oil separator;

a second chamber coupled to a sump;

a connector extending between said first and second chambers, said connector defining a fluid path along which oil can flow between the first and second chambers; and a conduit disposed within said connector that provides a path for crankcase blow-by gases that is separate from said fluid path.

2. An oil drainage device as set forth in claim 1, wherein said first chamber includes a bottom wall, said bottom wall having a hole through which oil can enter said fluid path.

3. An oil drainage device as set forth in claim 2, wherein said second chamber includes an upper wall, said upper wall having an aperture through which oil passes from said connector to said second chamber.

4. An oil drainage device as set forth in claim 2, wherein said conduit includes a top end that is vertically spaced apart from said bottom wall of said first chamber, such that a flow of said blow-by gases does not interfere with a flow of said oil to said fluid path.

5. An oil drainage device as set forth in claim 3, wherein said bottom end of said conduit includes a flange that flares outwardly to form an inverted funnel that tends to separate said blow-by gases from said oil.

6. An oil drainage device as set forth in claim 5, wherein said conduit includes a flange is vertically spaced apart from said upper wall of said second chamber to allow oil to flow from said connector into said second chamber with minimal interference from said blow-by gases.

7. An oil drainage device as set forth in claim 2, wherein said bottom wall is angled downwardly toward said hole.

8. An oil drainage device as set forth in claim 3, wherein said connector includes a boss that extends into a corresponding recess formed in one of the first and second chambers, said boss being fixedly secured to said corresponding recess to connecting said connector to said one of said first and second chambers.

9. An oil drainage device for an oil separator of an internal combustion engine, said oil drainage device comprising:

a first chamber that receives oil from the oil separator;

a second chamber coupled to a sump;

a connector extending between said first and second chambers;

a fluid path extending through said connector along which oil can flow between the firm and second chambers; and a path extending through said connector through which crankcase blow-by gases can flow and remain substantially separated from said oil flowing along said fluid path.

* * * * *

UNITED STATES PATENT AND TRADEMARK OFFICE

CERTIFICATE OF CORRECTION

PATENT NO. : 7,383,829 B2
APPLICATION NO. : 11/350422
DATED : June 10, 2008
INVENTOR(S) : Tenghua Tom Shieh It is certified that error appears in the above-identified patent and that said Letters Patent is hereby corrected as shown below:

Column 6, line 16 replace “firm” with --first--

Signed and Sealed this

Twenty-sixth Day of August, 2008

JON W. DUDAS
*Director of the United States Patent and Trademark Office*